United States Patent [19]

Bochenek et al.

[11] 4,010,060

[45] Mar. 1, 1977

[54] METHOD AND APPARATUS FOR MAKING A COAXIAL ELECTRIC CABLE

[75] Inventors: Eduard Bochenek, Hofheim, Taunus; Heinz Heumann, Rheydt; Viktor Pohl, Walsum, all of Germany

[73] Assignee: AEG-Telefunken Kabelwerke AG, Rheydt, Germany

[22] Filed: June 16, 1975

[21] Appl. No.: 586,859

Related U.S. Application Data

[63] Continuation of Ser. No. 459,327, April 9, 1974, abandoned.

[30] Foreign Application Priority Data

Apr. 9, 1973 Germany ..... 2317766
Apr. 9, 1973 Germany ..... 7313416[U]

[52] U.S. Cl. ..... 156/425; 53/259; 156/47; 156/443; 156/552

[51] Int. Cl.[2] ..... B65H 8/00

[58] Field of Search ..... 156/53, 55, 47, 187, 156/552, 558, 190, 191, 425, 443; 198/160, 165, 202, 204; 93/77 FT, 77 R; 53/177, 53, 258, 259; 174/15 C, DIG. 6

[56] References Cited

UNITED STATES PATENTS

| | | | |
|---|---|---|---|
| 2,048,817 | 7/1936 | Rosengarth | 425/391 X |
| 2,244,670 | 6/1941 | Benedict | 198/160 X |
| 2,875,890 | 3/1959 | Good | 198/165 X |
| 2,957,285 | 10/1960 | Molins | 53/177 X |
| 3,103,165 | 9/1963 | Tripp | 198/165 X |
| 3,231,063 | 1/1966 | Talbot | 198/165 X |

*Primary Examiner*—David A. Simmons
*Attorney, Agent, or Firm*—Spencer & Kaye

[57] ABSTRACT

In the manufacturing of a coaxial cable wherein conductors are continuously wound about support sleeves introduced in succession to a winding station, there is provided a slotted guide tube accommodating the support sleeves in an end-to-end axial series and leading to the winding station and a feeding mechanism which projects through the tube slot for engaging and advancing the support sleeves.

6 Claims, 4 Drawing Figures

METHOD AND APPARATUS FOR MAKING A COAXIAL ELECTRIC CABLE

CROSS-REFERENCE TO RELATED APPLICATION

This application is a continuation of application Ser. No. 459,327, filed Apr. 9, 1974, now abandoned.

BACKGROUND OF THE INVENTION

This invention relates to a method and apparatus for making electric cables, particularly hollow cables through which a very low temperature coolant may be passed during operation. The invention is in particular concerned with the feeding of a conductor support to the winding station where conductors are continuously wound about the support. The support is constituted by an axial series of ring- or sleeve-like elements on which the conductors — which expediently have a ribbon shape — are wound to extend about and coaxially with respect to the cable axis.

Support arrangements of the above type are known in general. It has been proposed as disclosed in German Pat. No. 2 020 735, published Oct. 26, 1972 (Auslegeschrift) to maintain the support sleeves axially spaced from one another and to hold them together by winding thereabout foils or bands to thus obtain a portable, hose-like structure. This support arrangement has the advantage that, between itself and the supported conductors of the cable no impermissible forces can appear, since the differences of the thermal coefficients of contraction, because of the free displaceability of the support sleeves in the axial direction, do not lead to impermissible relative motions of the support sleeves with respect to the conductors. For assembling the cable, it has been proposed to loosely interconnect the support sleeves with one another in the axial direction by means of rods or small wire hooks.

It is a disadvantage of the above-described arrangement that the coupling components between the support sleeve effect a very unreliable and non-uniform connection. As the thus assembled support sleeves are advanced to the first cable winding station where the first layer of bands (for example, conductor ribbons) is applied, there may easily occur changes in the axial direction or relative radial shifts of the support sleeves. For this reason, the layers of the conductors applied to the support arrangement are often irregular.

SUMMARY OF THE INVENTION

It is an object of the invention to provide a method and an apparatus by means of which the support sleeves of a support arrangement can be advanced to the cable winding station in a simple, reliable and uniform manner.

This and other objects to become apparent as the specification progresses are achieved by the invention, according to which, briefly stated, the support sleeves are advanced in a longitudinally slotted guide tube to the winding station in an unattached, end-to-end contacting relationship by a feed mechanism which has a component that extends into the guide tube through its slot for engaging and axially moving the support sleeves.

The advantage of the method and apparatus according to the invention resides in that the support sleeves are continuously advanced to the cable winding station securely and uniformly without the use of complex machinery. Relatively complex preparatory steps, such as the interconnection of the support sleeves by means of rods or hooks, are no longer necessary.

DESCRIPTION OF THE PREFERRED EMBODIMENT

Figure 1:
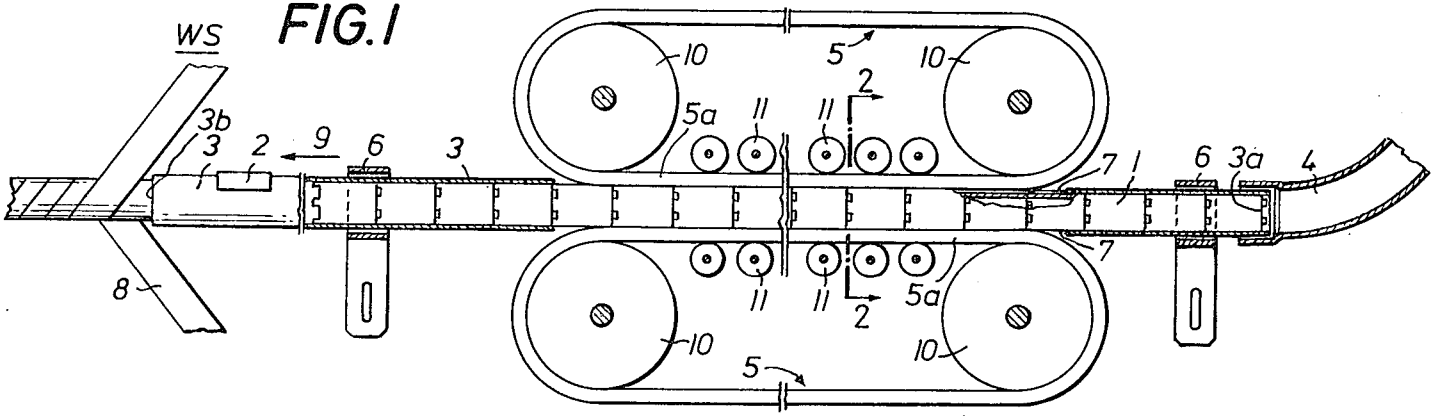
FIG. 1 is a schematic longitudinal sectional view of a preferred embodiment of the invention.
Figure 2:
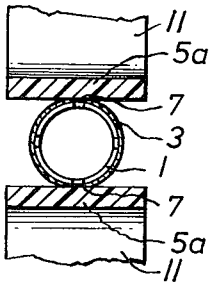
FIG. 2 is a fragmentary sectional view taken along line 2—2 of FIG. 1.

Turning now to FIG. 1, there are illustrated support sleeves 1 which are introduced into an inlet end 3*a* of a guide tube 3 through an upwardly bent pipe 4 to which the sleeves 1 may be fed in sequence by a mechanism not shown. The generally horizontal guide tube 3 which may be externally supported by brackets 6, has two diametrically opposed, throughgoing slots 7 which extend parallel to the tube axis. Adjacent each slot 7 there is disposed a feeding mechanism, each having a driven endless feed belt 5 trained about end rollers 10. One reach 5a of each belt 5 projects, at least with a portion of its width, through the adjacent slot 7 of the guide tube 3 and frictionally engages the superficies of several support sleeves 1 serially arranged in the guide tube 3. To ensure a good contact between the outer face of the reach 5a and the support sleeves 1, there are provided a series of backup rollers 11, which are in engagement with the inner faces of each reach 5*a* for urging the latter towards the support sleeves 1. The belts 5 advance the support sleeves 1 within the guide tube 3 in the direction of arrow 9 to a conventional winding station WS where bands, such as conductor ribbons 8 made of copper and coated with a superconducting material are wound about the support sleeves 1 as these emerge in succession from the discharge end 3*b* of the guide tube 3. In this manner, from the loosely arranged axial series of support sleeves 1 a coherent, flexible, hose-like structure is formed. For supervising the feed of the support sleeves 1, in the guide tube 3, between the belts 5 and the winding station WS, an observation window 2 is provided.

It is to be understood that instead of endless belts 5 other devices may be used (such as chain-supported engaging shoes, etc.) that are adapted to engage the support sleeves 1 in the guide tube 3 through the slots 7 for advancing the sleeves towards the cable winding station. Further, instead of two slots 7, a single slot provided in the guide tube 3 may suffice.

Figure 3:
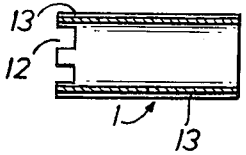
FIGS. 3 and 4 are, respectively, axial and radial sectional views of a component shown in FIG. 1.
Figure 4:
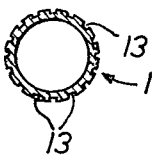

Turning now to FIGS. 3 and 4, there is illustrated a support sleeve 1 of elongated cylindrical shape particularly adapted to be handled by the apparatus according to the invention. One axial terminus of the support sleeve 1 is crenellated as indicated at 12. As it may be observed in FIG. 1, the crenellated end 12 of each support sleeve is in abutting relationship with the smooth, other axial terminus of an immediately adjoining support sleeve in the guide tube 3. Further, the outer face of the support sleeve 1 is provided with a series of grooves 13, whereby a serrated surface is obtained. This lowers the friction between the support sleeve 1 and the inner wall of the guide tube 3 and at the same time ensures that the sleeve is securely grasped by the belt 5. The grooves may extend either axially or circumferentially. It is noted that the groove series on the support sleeve provides space for a coolant between the support sleeve and the conductors wound thereabout.

It will be understood that the above description of the present invention is susceptible to various modifications, changes and adaptations, and the same are intended to be comprehended within the meaning and range of equivalents of the appended claims.

We claim:

1. An apparatus for making an axially hollow, coaxial electric cable including support sleeves arranged in an axial series in an unattached end-to-end contacting relationship and a conductor helically wound on the support sleeves; comprising in combination:

a. a winding station for helically winding the conductor about the support sleeves;

b. a guide tube accommodating and maintaining the support sleeves within its confines in an axially aligned relationship; said guide tube including 1. an inlet end through which the support sleeves are introduced in sequence into said guide tube;
2. a discharge end situated in said winding station in the immediate vicinity of a location where the conductor runs onto the support sleeves;
3. means defining a longitudinal, slotlike, throughgoing opening extending in the length dimension of said guide tube along at least one length portion thereof;

c. means connected to said inlet end for introducing the support sleeves in unattached succession into said guide tube; and d. a feeding mechanism including means projecting through said opening for continuously engaging successive support sleeves in said guide tube for continuously shifting them towards and up to said discharge end in an end-to-end contacting relationship.

2. An apparatus as defined in claim 1, wherein said feeding mechanism includes a driven endless belt having one reach extending along said guide tube, said reach having an outer face and a reverse, inner face, at least one portion of said outer face projecting through said opening for frictionally engaging the superficies of the support sleeves within said guide tube.

3. An apparatus as defined in claim 2, including roller means engaging said inner face of said reach for urging said outer face inwardly through said opening.

4. An apparatus as defined in claim 2, wherein there are provided two diametrically opposed longitudinal, slot-like, throughgoing openings in said guide tube, with each opening there being associated a separate said feeding mechanism.

5. An apparatus as defined in claim 1, wherein said means connected to said inlet end of said guide tube includes an upwardly bent pipe.

6. An apparatus as defined in claim 1, including means defining an observation window in said guide tube between the feeding mechanism and the winding station.

* * * * *